US005370527A

United States Patent [19]

Hefling et al.

[11] Patent Number: 5,370,527

[45] Date of Patent: Dec. 6, 1994

[54] FUEL TUBE FOR BURNER ASSEMBLY WITH REMOTE FUEL TANK

[75] Inventors: Dennis V. Hefling; Matthew S. Copeland, both of Wichita, Kans.

[73] Assignee: The Coleman Company, Inc., Wichita, Kans.

[21] Appl. No.: 967,807

[22] Filed: Oct. 28, 1992

[51] Int. Cl.[5] ..... F23D 11/44; F16L 29/00

[52] U.S. Cl. ..... 431/247; 431/344; 126/39 R; 126/38; 251/149.6

[58] Field of Search ..... 431/344, 345, 244, 247, 431/248; 126/39 R, 85 R, 38; 285/317, 320; 251/149.1, 149.6

[56] References Cited

U.S. PATENT DOCUMENTS

| | | | |
|---|---|---|---|
| 1,718,473 | 6/1929 | McCutchen . | |
| 1,858,264 | 5/1932 | Coleman . | |
| 1,958,400 | 5/1934 | Tullis . | |
| 3,648,680 | 3/1972 | Hein . | |
| 3,807,687 | 4/1974 | Thompson | 251/149.6 X |
| 3,829,278 | 8/1974 | Penberthy . | |
| 3,876,364 | 4/1975 | Hefling . | |
| 3,900,281 | 8/1975 | Penberthy . | |
| 4,177,646 | 12/1979 | Guadagnin . | |
| 4,458,719 | 7/1984 | Strybel | 285/320 X |
| 4,506,695 | 3/1985 | Kuypers . | |
| 4,613,112 | 9/1986 | Phlipot et al. | 251/149.6 |
| 4,779,608 | 10/1988 | Smith | 431/344 X |
| 4,836,235 | 6/1989 | Pagani . | |
| 4,878,649 | 11/1989 | Baba . | |
| 4,886,086 | 12/1989 | Etchells . | |
| 5,007,448 | 4/1991 | Olinger . | |
| 5,027,845 | 7/1991 | Silagy | 251/149.6 |
| 5,081,847 | 1/1992 | Anderson . | |
| 5,123,677 | 6/1992 | Kreczko et al. | 285/320 X |
| 5,150,880 | 9/1992 | Austin, Jr. et al. | 285/320 X |

OTHER PUBLICATIONS

MSR Whisper Lite Operating Instructions (no date).

*Primary Examiner*—Carl D. Price

[57] ABSTRACT

A burner appliance includes a burner assembly, a separate fuel tank, and a tube connecting the fuel tank and the burner assembly. A restrictor rod is positioned within the tube for minimizing fuel surge, enhancing generation of vaporized fuel, and reducing flame pulsation. The restrictor rod is part of a sealing valve which provides secondary shut-off of fuel in the event that the tube is disconnected from the burner assembly.

13 Claims, 2 Drawing Sheets

FUEL TUBE FOR BURNER ASSEMBLY WITH REMOTE FUEL TANK

BACKGROUND

This invention relates to a burner appliance which includes a burner assembly and a fuel tank which is separate or remote from the burner assembly. More particularly, the invention relates to a fuel tube for connecting the fuel tank and the burner assembly.

Burner appliances such as campstoves generally include a burner assembly for producing a heating flame and a fuel tank for providing fuel to the burner. Some burner appliances have a remote fuel tank which is separated from the burner assembly and which is connected to the burner assembly by a long tube or hose. However, the connecting tube or hose causes difficulty in providing instant lighting of the burner, i.e., generation of vaporized fuel. After the burner is used, residual fuel remains in the tube. On the next lighting, the residual fuel can rush into the burner and cause flooding of the burner or a high yellow flame which can slow the generation of the vaporized fuel. If the tube is disconnected from the burner assembly, residual fuel in the tube can drain from the tube. The draining fuel can be objectionable and can damage food or clothing which is packed with the burner appliance.

Other prior art remote burner appliances used generator preheating for lighting. Alcohol or preheating paste was used to heat the generator. U.S. Pat. Nos. 1,718,473 and 1,858,264 describe an instant lighting feature for short fuel conduits without preheating. However, the structure is not practical for instant lighting for long conduits or tubes where residual fuel remains in the tube.

To minimize fuel surge that can lead to flooding and slow generation on instant lighting, some previous designs used small diameter capillary tubes. However, capillary tubes were fragile and not suitable for the rugged requirements of camping service.

Flow restrictors such as coils have long been used inside of generators which provide vaporized fuel. See, for example, U.S. Pat. No. 1,958,400. However, narrow clearances inside the generator which were required for flow restriction were impractical because carbon build-up inside the generator would quickly block fuel flow.

U.S. Pat. No. 3,900,281 describes a backpacker's stove which includes a burner and a remote fuel tank. However, the connecting tube does not include any flow restrictor, and there is no seal which prevents the tube from draining when the tube is disconnected. Backpacker's stoves which are sold by the owner of U.S. Pat. No. 3,900,281 include a cable in the fuel tube which connects the burner and the fuel tank. It is believed that the cable is intended to reduce the amount of fuel in the tube in order to increase the response of the flame to adjustments of the fuel valve on the tank and to reduce the length of time the flame continues to burn after the valve is shut off. The stove does not have an instant lighting feature.

SUMMARY OF THE INVENTION

The invention incorporates a simple flow restrictor in the fuel tube between the fuel tank and the gas tip orifice of the burner. The flow restrictor reduces the surge effect on lighting, reduces the likelihood that the burner will be flooded with liquid fuel, which causes yellow flame or smoke, and reduces flame pulsation during burning. The restrictor allows the use of a full size fuel hose which is rugged enough for camping and backpacking service. The fuel tank is pressurized with air for delivering the fuel, and the restrictor reduces the amount of pressurizing air which is lost during the initial surge of fuel and air when the appliance is turned on. Fewer pumping strokes are therefore required for lighting. The pressure drop which is caused by the restrictor enhances the fuel vaporization process. The fuel/air mixture achieves partial vaporization in the reduced pressure region, thereby improving instant lighting. The restrictor also incorporates a seal which provides secondary shut-off of fuel when the tube is disconnected from the burner.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
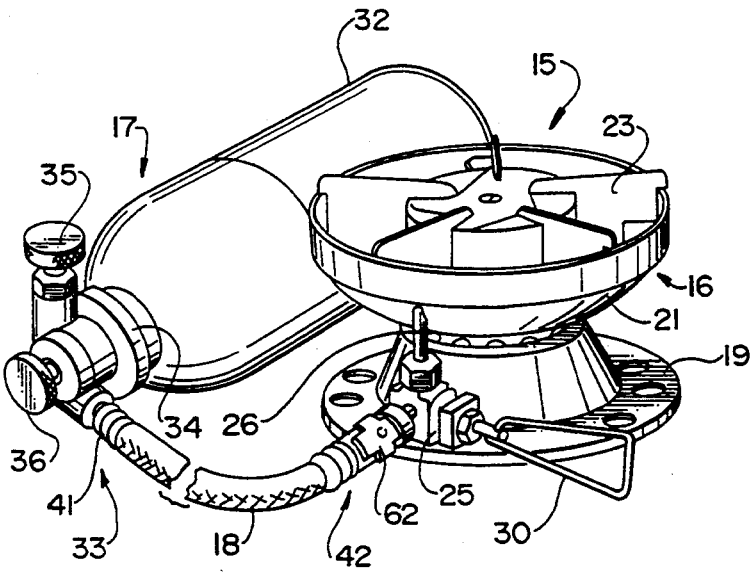
FIG. 1 is a perspective view, partially broken away, of a campstove which includes a burner, a fuel tank, and a fuel hose.

Referring first to FIG. 1, the invention will be explained in conjunction with a backpacking campstove 15. It will be understood, however, that the invention can be used with other fuel-burning appliances. The campstove includes a burner assembly 16, a fuel tank assembly 17, and a fuel hose or tube 18 which connects the fuel tank and the burner assembly.

Figure 2:
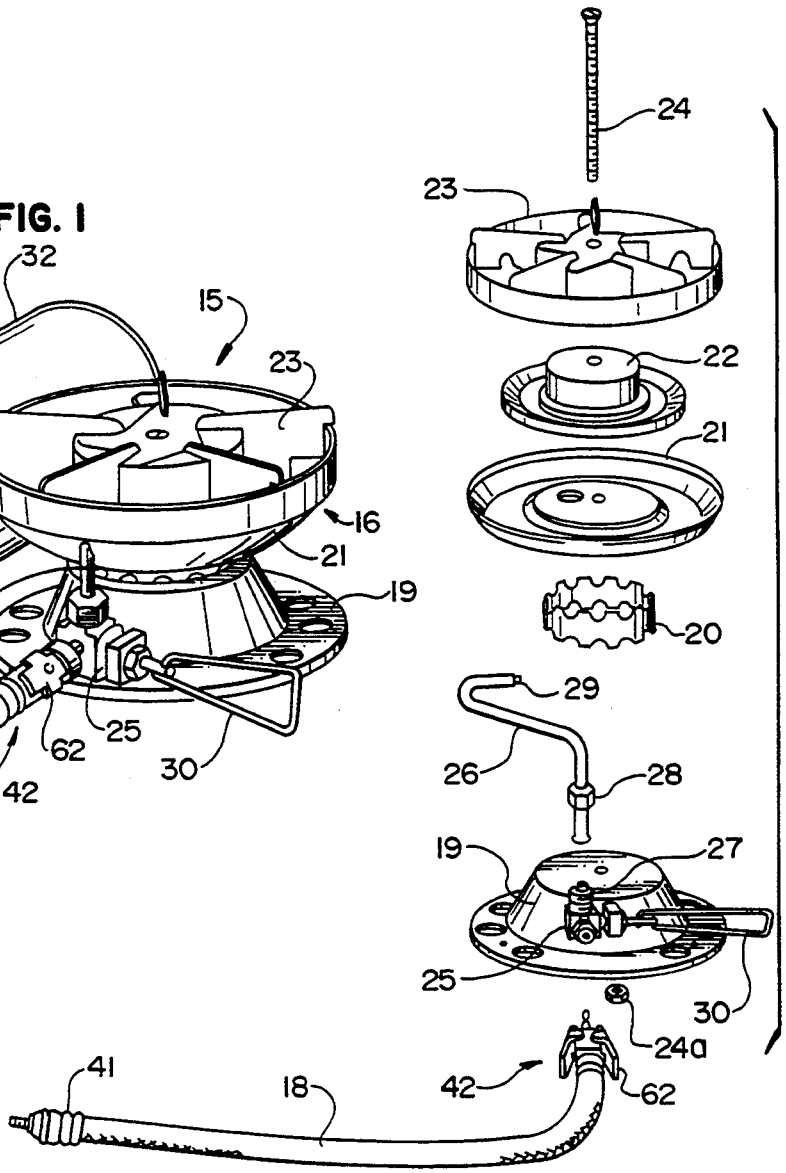
FIG. 2 is an exploded perspective view of the burner and the hose.

Referring to FIG. 2, the burner assembly includes a base 19, a support collar 20, a burner pan 21, a burner 22, and a grate 23. The parts are clamped together by a bolt 24 and a nut **24*a*. A burner valve housing 25 is mounted on the base, and a generator tube 26 is connected to a threaded nipple 27 on the burner valve housing by a nut 28. The upper end of the generator tube is shaped to curve around the burner and terminates in a gas tip 29. An operating handle 30 is connected to a burner valve within the housing 25** for adjusting the size of the flame at the burner. The details of the burner assembly are conventional and well known.

Figure 3:
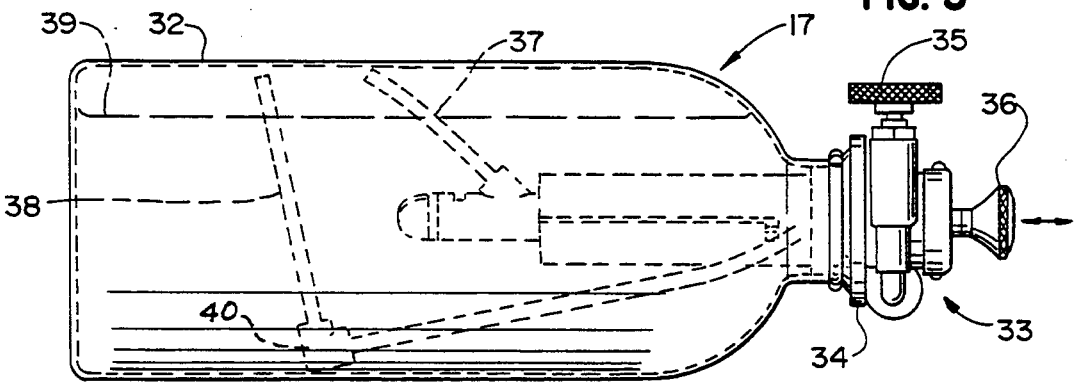
FIG. 3 is a side elevational view of the fuel tank.
Figure 4:
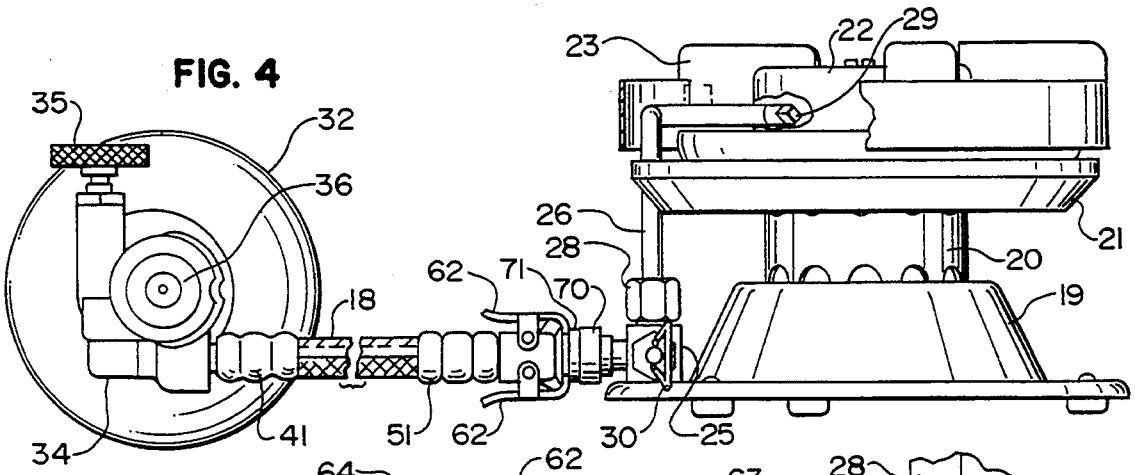
FIG. 4 is a side elevational view of the burner and an end view of the fuel tank.

The fuel tank assembly 17 includes a fuel bottle 32 and a pump and valve assembly 33. The pump and valve assembly includes a housing 34 which screws into the fuel bottle, an operating knob 35 for opening and closing the valve, and a pump handle 36 for pumping air into the fuel bottle. Referring to FIG. 3, a first tube 37 extends from the housing 34 at an angle to the axis of the fuel bottle and is connected to the pump. A second L-shaped tube 38 extends from the neck portion of the housing.

The fuel tank assembly is designed for use when the fuel bottle is lying with its axis horizontal and the ends of the tubes 37 and 38 extend upwardly as illustrated in FIG. 3. The fuel level is indicated by the line 39, and the ends of the tubes 37 and 38 extend into the air space above the fuel. The L-shaped tube 38 includes an elbow 40 which is submerged in the fuel. A small orifice in the elbow permits fuel to flow through the tube when the valve is opened. The orifice in the elbow is larger than the orifice in the gas tip 29. The air space is pressurized by reciprocating the pump handle 37. When the valve is opened by turning the knob 35, a mixture of fuel and air flows through the tube 38, past the valve, and into the connecting hose 18. The details of the pump and the valve are conventional and well known and need not be described herein.

The fuel hose 18 includes a first end fitting 41 which is attached to the housing 34 and a restrictor assembly 42 on the other end which is adapted to connect to the burner valve 25 housing. Referring to FIGS. 5–10, the restrictor assembly includes a tubular probe 43 which has a tapered outer end 44, a cylindrical central portion 45, and a barbed inner end portion 46 which includes conical barbs 47. The barbs are sized to be frictionally retained within the internal bore 48 of the fuel hose. The particular fuel hose illustrated includes a rubber tube 49 and a woven outer sheath 50. After the barbed end of the probe is inserted into the rubber tube, a ferrule 51 is crimped over the end of the hose to secure the probe.

A restrictor rod 53 extends through the bore of the probe. The diameter of the rod is slightly less than the internal diameter of the probe to provide an annular space 54 through which the fuel and air mixture can flow from the fuel hose to the burner.

An O-ring seal 56 is mounted on the inside end of the restrictor rod and is retained by a nut 57 which is threaded onto the rod. A coil spring 58 is retained on the outer end of the rod by a nut 59. The inner end of the spring engages a shoulder 60 in the bore of the probe. The coil spring resiliently biases the O-ring against the inner end of the probe to seal the bore of the probe when the probe is not connected to the burner valve housing.

A pair of L-shaped retaining clips 62 are pivotally mounted on a clip housing 63 which is mounted on the probe. Each clip includes a finger portion 64 and a jaw portion 65. The clips are pivotally mounted on pins 66 which extend through openings 67 in the clip housing. Springs 68 extend into openings 69 in the clip housing and resiliently bias the jaws 65 of the clip toward the probe.

A tubular fitting 70 (FIG. 5) extends into an opening in burner valve housing 25 and is secured by brazing. A tubular probe fitting 71 is screwed into the fitting 70 and captures an O-ring 72 against a shoulder 73 within the fitting 70. A circumferential groove 74 in the probe fitting is sized to receive the jaws 65 of the probe clips 62.

Figure 5:
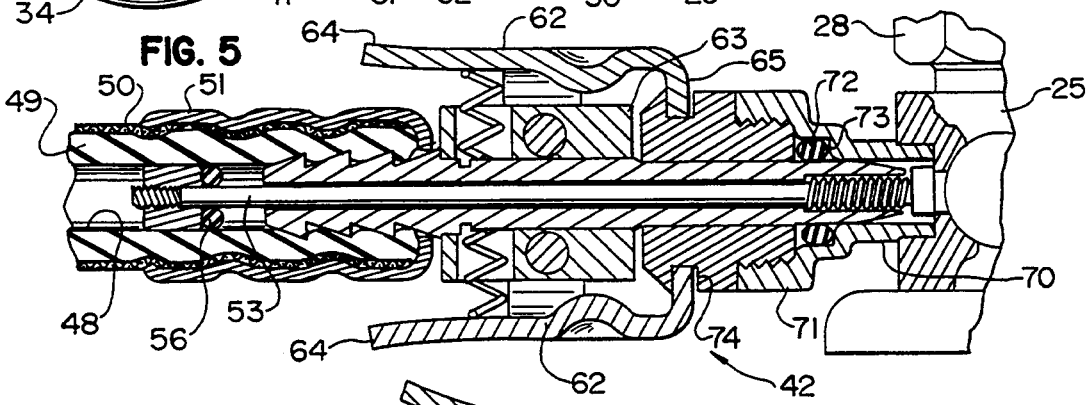
FIG. 5 is an enlarged fragmentary sectional view of the connection between the fuel hose and the burner.

The fuel hose is connected to the burner assembly by inserting the probe 43 into the bore of the fitting 71. As the restrictor rod 63 engages the burner valve housing 25, the restrictor rod slides within the probe and compresses the spring 58. The O-ring 72 seals against the probe and prevents fuel from leaking through the fittings 70 and 71. The probe is releasably latched to the burner valve housing by pressing the finger portions 64 of the retaining clips 62 to permit the jaws 65 to clear the fitting 71. The finger portions are released when the jaws are aligned with the groove 74 in the fitting 71 (FIG. 5).

The burner is lit by turning the flame adjusting handle 30 to the high position, holding a lighted match at the burner, and opening the fuel valve by turning the knob 35. A fuel/air mixture flows from the fuel bottle through the fuel hose. The restrictor rod 53 in the probe slows the flow of fuel/air to the burner and reduces the surge effect when the fuel valve is opened. The coil spring 58 also restricts the fuel/air flow. Minimizing the surge effect reduces the likelihood that the burner will be flooded with liquid fuel. The restrictor rod also reduces the amount of pressurized air which is lost from the fuel bottle during the initial fuel/air surge, thereby reducing the number of pumping strokes required for lighting and enhancing operator convenience.

The pressure drop of the fuel/air mixture which is created by the restrictor rod also enhances the process of vaporizing the fuel. The portion of the fuel path before the restrictor rod is a high pressure region, and the portion of the fuel path between the restrictor rod and the orifice in the gas tip 29 is a low pressure region. The fuel/air mixture achieves partial vaporization in the low pressure region. This results in improved instant lighting, particularly at low temperatures.

Other means for providing flow restriction include fillers such as beads, porous plastic rod and other porous materials, orifices, screens, coil springs, and annular restrictors. However, the particular restrictor means described provides consistent, reliable results.

After the generator tube 26 is heated by the burner flame, vaporization of the fuel/air mixture occurs within the generator tube. The flame adjuster handle 30 is then turned to adjust the flame to the desired heat. The restriction provided by the restrictor rod 53 and the coil spring 58 thereafter functions to reduce flame pulsation during burning.

Figure 6:
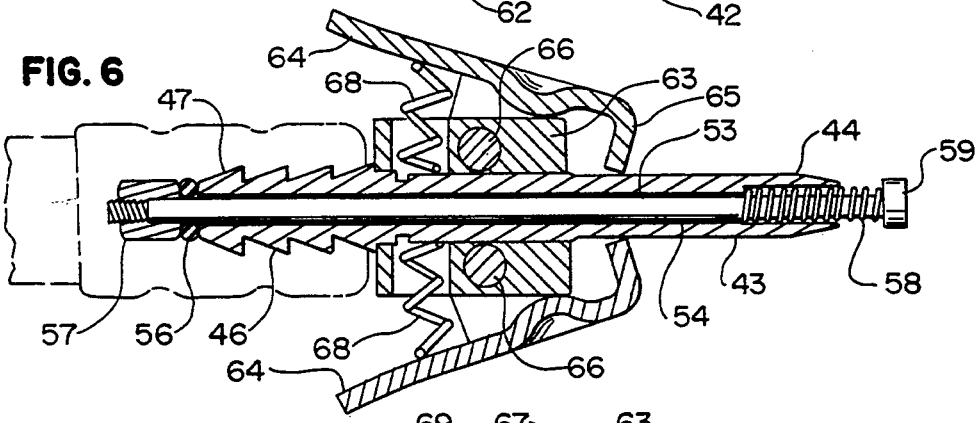
FIG. 6 is a sectional view of the restrictor assembly.
Figure 7:
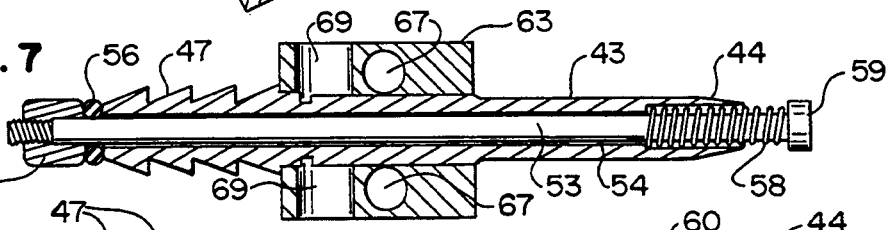
FIG. 7 is a view similar to FIG. 6 of a portion of the restrictor assembly.
Figure 8:
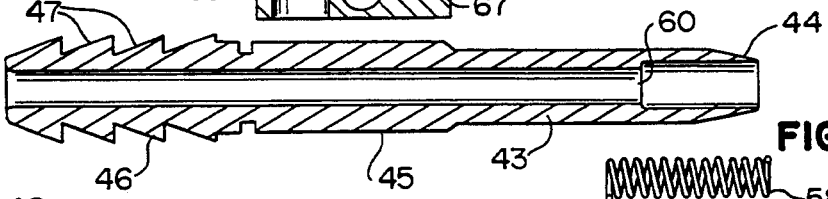
FIG. 8 is a sectional view of the probe.
Figure 9:
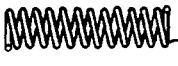
FIG. 9 is an elevational view of the spring of the restrictor assembly.
Figure 10:
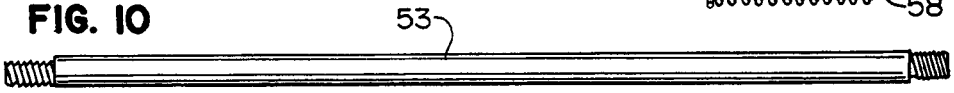
FIG. 10 is an elevational view of the restrictor rod.

The spring-loaded restrictor rod and O-ring seal 56 provide a secondary shut-off which minimizes fuel leakage when the fuel hose is disconnected from the burner assembly. When the probe moves away from the burner valve housing, the coil spring moves the O-ring into sealing engagement with the inner end of the probe (FIG. 6). The fuel hose can therefore be disconnected from the burner for transporting the campstove without having residual fuel in the fuel hose drain from the hose.

In one specific embodiment of the invention the internal diameter of the probe 43 was 0.05 inch, and the diameter of the radially enlarged end of the bore provided by the shoulder 60 was 0.096 inch. The diameter of the restrictor rod 53 was 0.062 inch. The coil spring 58 was formed from 0.012 wire stainless steel and had an outside diameter of 0.088 inch.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A liquid fuel burning appliance comprising:

a burner assembly including a burner for providing a flame and a generator in heat exchange relationship with the burner for vaporizing liquid fuel within the generator, a fuel tank separate from the burner for holding liquid fuel, a fuel valve on the fuel tank, means for pressurizing the fuel tank, a fuel tube connecting the fuel valve and the burner assembly for conveying pressurized liquid fuel to the burner assembly, the fuel tube having an upstream end which is connected to the fuel valve, a downstream end which is connected to the burner assembly, and an internal bore through which the fuel flows, and flow-restricting means positioned within the bore of the fuel tube adjacent the downstream end of the fuel tube for restricting the flow of fuel through the fuel tube, for reducing the pressure of the pressurized fuel downstream of the downstream end of the fuel tube, and for reducing surge of liquid fuel when the valve is open.

2. The burner appliance of claim 1 in which said flow-restricting means includes a rod within the bore.

3. The burner appliance of claim 1 in which said flow-restricting means includes a tubular probe having a bore and a first end which is inserted into the bore of the tube and a second end which is adapted to be connected to the burner assembly, and a rod which is positioned within the bore of the probe.

4. The burner appliance of claim 3 in which said rod is reciprocable within the bore of the probe and includes a first end which extends beyond the first end of the probe and a second end which extends beyond the second end of the probe, seal means mounted on the first end of the rod for sealing the bore of the probe at the first end of the probe, and spring means on the second end of the probe for resiliently biasing the seal means against the first end of the probe.

5. The burner appliance of claim 4 in which said spring means includes a coil spring which is ensleeved on the second end of the rod and extends into the bore of the probe.

6. The burner appliance of claim 4 in which said rod is reciprocable between a sealing position when the probe is disconnected from the burner assembly and an open position when the probe is connected to the burner assembly, the seal means engaging the first end of the probe when the rod is in the sealing position and being spaced from the first end of the probe when the rod is in the open position.

7. The burner appliance of claim 6 including latch means on the tube for releasably latching the probe to the burner assembly.

8. The burner appliance of claim 6 in which said burner assembly includes a tubular fitting into which the second end of the probe can be inserted for connecting the tube to the burner assembly, the tubular fitting having a groove which is engageable by said latch means.

9. The burner appliance of claim 8 in which said latch means includes a pair of generally L-shaped clips which are pivotally mounted on the probe, each of the clips including a finger portion which extends generally parallel to the bore of the probe and a latching portion which extends toward the probe generally perpendicularly to the finger portion, and spring means for resiliently biasing the latching portions toward the probe.

10. The burner appliance of claim 4 in which said seal means comprises an O-ring mounted on the first end of the rod.

11. The burner appliance of claim 3 in which the first end of the probe includes barbs for retaining the first end within the tube.

12. The burner appliance of claim 3 in which said tube is flexible.

13. The burner appliance of claim 1 in which said tube is flexible.

* * * * *